United States Patent [19]

Stabel et al.

[11] 3,942,453

[45] Mar. 9, 1976

[54] RAILWAY CAR MIXER FOR THE TRANSPORT OF MOLTEN METALS

[75] Inventors: Michael Stabel; Matthias Scheulen, both of Junkerath, Germany

[73] Assignee: Demag, A.G., Germany

[22] Filed: Oct. 1, 1974

[21] Appl. No.: 511,064

[30] Foreign Application Priority Data

Feb. 1, 1974 Germany ..... 24048688

[52] U.S. Cl. ..... 105/265; 105/362

[51] Int. Cl.[2] ..... B61D 3/00

[58] Field of Search ..... 105/264 T, 264 R, 264 V, 105/267, 270, 271, 358, 360, 362, 423; 308/178, 204

[56] References Cited

UNITED STATES PATENTS

| | | | |
|---|---|---|---|
| 1,004,346 | 9/1911 | Becker | 308/204 X |
| 1,980,895 | 11/1934 | Windecker | 105/271 |
| 3,070,039 | 12/1962 | Mohr | 105/271 |
| 3,589,303 | 6/1971 | Lakin | 105/358 X |

*Primary Examiner*—John J. Love

*Attorney, Agent, or Firm*—Mandeville and Schweitzer

[57] ABSTRACT

Disclosed herein is railway apparatus or the like for mixing and transporting molten metals, particularly pig iron, which essentially comprises a longitudinal, refractory lined cylindrical vessel, provided at its opposite ends with removable cover members and also provided with a self-contained drive unit for rotating the vessel about its longitudinal axis. This vessel, with its associated self-contained drive unit, is removably supported beneath its ends upon two spaced railroad trucks, through ball joints associated therewith. The vessel and drive unit may be readily separated from the underlying trucks for installation, maintenance, and/or removal of the refractory lining in any desired vessel orientation, while the vessel is rotated by its self-contained drive unit.

8 Claims, 5 Drawing Figures

RAILWAY CAR MIXER FOR THE TRANSPORT OF MOLTEN METALS

BACKGROUND OF THE INVENTION

Industry practice with railway mixer-transport cars has shown that the efficiency and the economy of operating such vehicles for transporting liquid metals is substantially affected by the difficult and burdensome methods employed heretofore in installing vessel linings. Approximately 20–25% of the operating time of these cars is used for the removal of old linings and the installation of new ones, typically mostly by inefficient procedures utilizing manual operations. This significant loss of operating time with conventional mixer-transport cars results in a large measure from the difficulty, and in some cases the impossibility, of using mechanized operations and automatic tools and devices for removing the old lining and installing a new one. Moreover, due to this lack of the efficient use of mechanized auxiliary devices, working conditions are extremely uncomfortable and oppressive, especially, for example, during the fracturing of the old refractory lining and subsequent removal of the fragments from the vessel. This, of course, tends to produce an extremely unpleasant atmosphere, which is not conducive to efficient work or easy to tolerate by the personnel replacing, removing, or repairing liners.

Accordingly, it is an objective of the present invention to employ modern, fully mechanized devices for installing, maintaining, and/or removing the lining, and to that end, to make the vessel readily accessible, and furthermore, to make possible the rotation of the vessel, after lifting it off the supporting railroad trucks to bring it into an inclined or vertical position. The identification and satisfaction of these highly desirable objectives represent the bases of the present invention. Indeed, the new and improved mixer described hereinafter is more efficient and more economical to operate than any comparable mixers heretofore known to the art.

For example, German patents DT-OS No. 1,936,770 and DT-OS No. 2,053,030 disclose mixer-transports of the type known to the art. While these patents include some structure found in the present invention, they do not disclose or suggest the principles of the present invention. Indeed, the mixer-transport of the present invention overcomes many of the shortcomings of the earlier patented apparatus.

SUMMARY OF THE PRESENT INVENTION

It is the major object of the present invention to provide a new and improved mixer-transport railway car for the transport of liquid metals, particularly pig iron. To that end, the apparatus of the present invention includes a rotatable, longitudinal, essentially cylindrical vessel provided with removable cover or head members on its ends. As a very important aspect of the present invention, the vessel is rotated about its longitudinal axis by a self-contained drive unit. Moreover, the vessel is supported at both ends on railway trucks through a separable ball joint, which facilitates and permits the ready separation of the vessel and its associated, self-contained drive unit from the underlying railway trucks. This unique arrangement, which lends itself to simplified construction, overcomes the disadvantages and eliminates many of the shortcomings of the prior art mixer-transport cars. Indeed, the vessel, once lifted off the underlying trucks, may be oriented into any position, while its interior, after both end covers are removed, is freely accessible to the mechanized removal, repair and/or replacement of the vessel lining.

As will be understood, the advantageous operation of the new apparatus is achieved, according to the invention, by having the driving unit located immediately adjacent the vessel and supported in relation therewith to form a structural entity, which entity is not separated or otherwise disrupted when the vessel structure is removed from the underlying trucks.

In accordance with another important aspect of the invention, the vessel is supported for rotation upon rollers disposed in races which cooperate to form a large roller bearing. The major load-bearing portion of the outer race is designed as a reinforced saddle segment, while the remainder of the roller bearing outer race is designed as a retaining plate guide. The roller saddle segment is firmly connected with the structural members supporting the self-contained drive units and, with a spherical rotary socket, forming the upper part of the separable ball joint through which the vessel is connected to the trucks.

For a better appreciation of the benefits of and advantages to be derived from the practice of the present invention, reference should be made to the accompanying drawings and the following detailed description of the new and improved mixer-transport apparatus.

DETAILED DESCRIPTION OF THE PRESENT INVENTION

Figure 1:
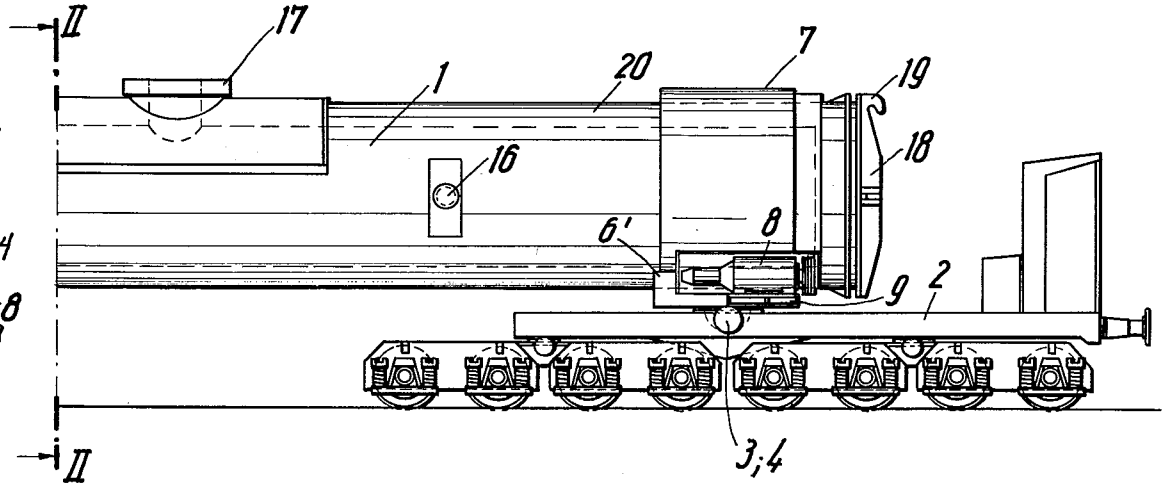
FIG. 1 is a partial, side elevational view of a mixer-transport railway car for the transport of molten pig iron or the like, which embodies the principles of the present invention.
Figure 2:
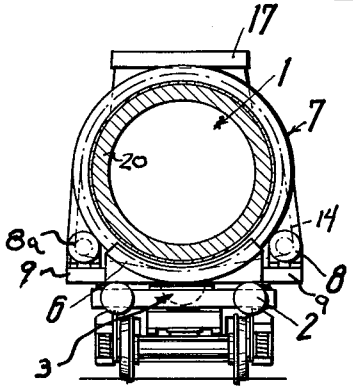
FIG. 2 is a transverse, cross-sectional view of the mixer-transport apparatus of FIG. 1 taken along line 2—2 thereof.

Referring now to FIG. 1, the new and improved mixer-transport railway car of the present invention includes an elongated, cylindrical vessel 1 supported at each end (only the righthand end being illustrated) by railway trucks 2 of conventional construction. Specifically, and as shown best in FIGS. 1 and 3, the tubular vessel 1 through its support structure is mounted upon the underlying railway trucks by a ball joint 3, and is stabilized thereon by chocks 4 straddling the ball joint and disposed at the edge of the trucks 2. More specifically, the vessel structure 1 is supported for rotation about its longitudinal axis in a large, circular roller bearing 7, the outer race of which comprises a lower, reinforced, saddle member 6 defining a partial outer race and an upper plate-like segmented race element **7*a*. When connected together, the race elements 6, 7*a* define a totally circular outer race for the roller bearing member 7, which cooperates with the inner race 5 to retain rollers 5*a* therebetween, as shown best in FIG. 3**.

Figure 3:
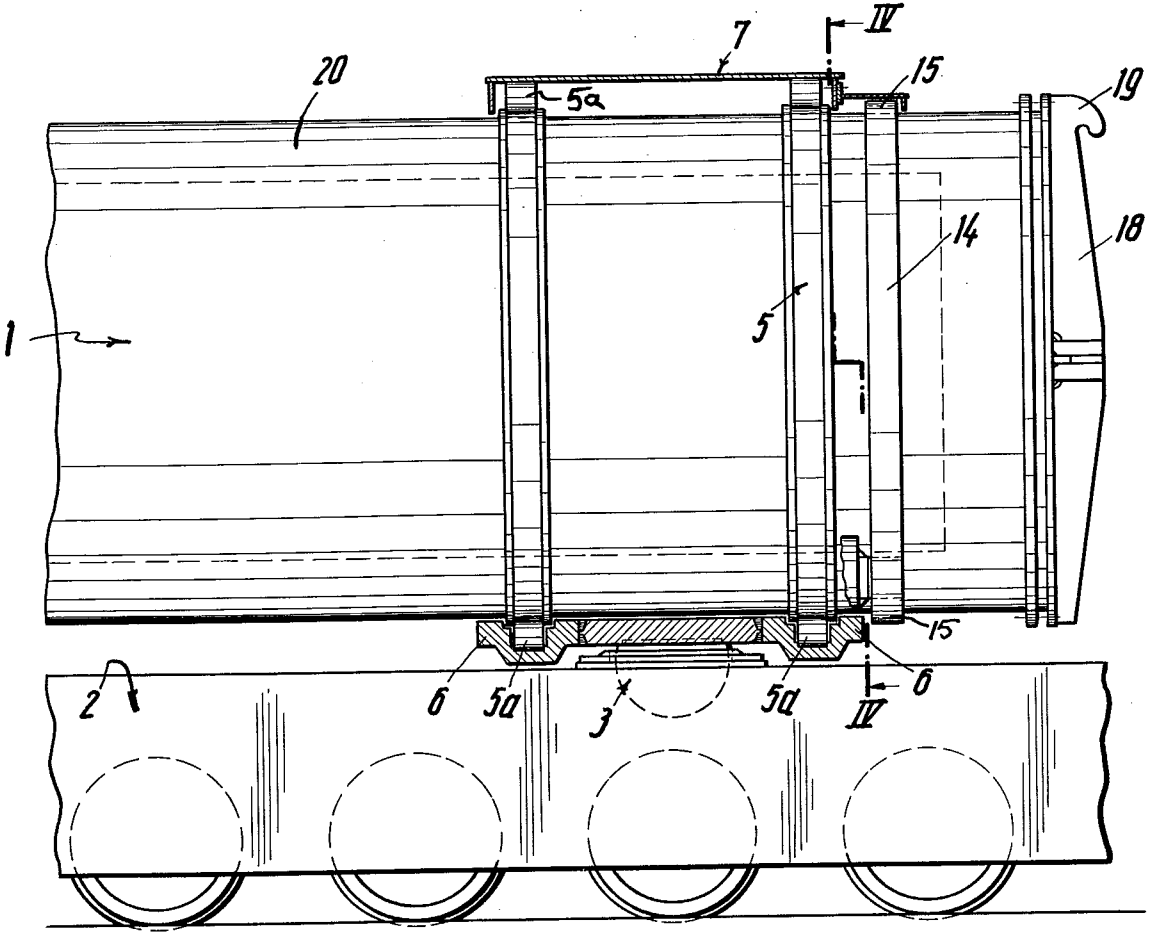
FIG. 3 is an enlarged, schematic, cross-sectional view of a mixer-transport vehicle embodying the principles of the present invention.
Figure 4:
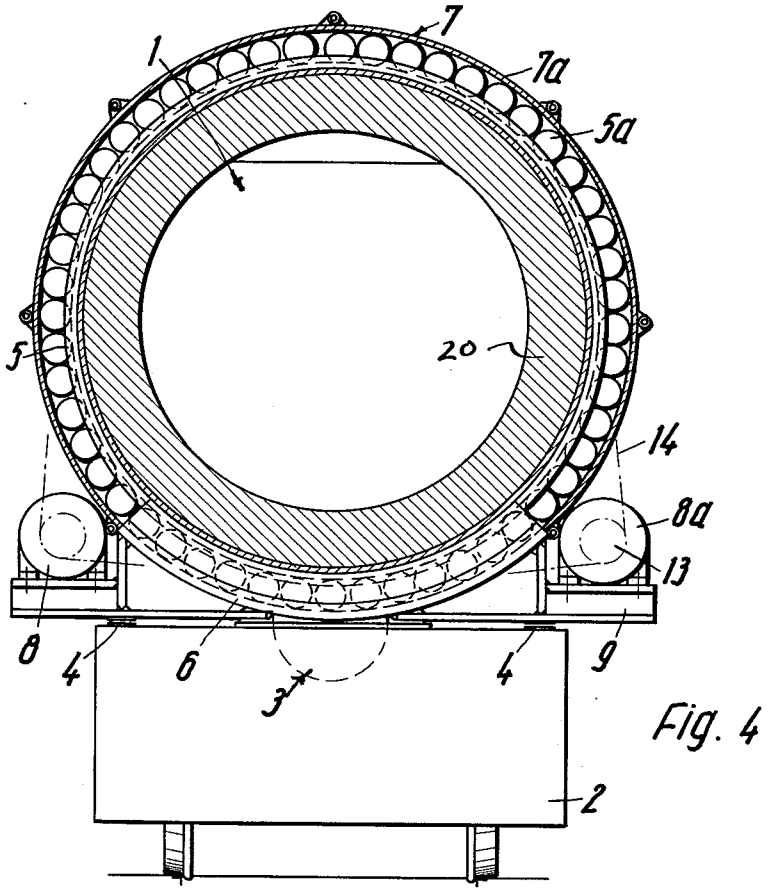
FIG. 4 is a cross-sectional view of the apparatus of FIG. 3 taken along line 4—4 thereof.
Figure 5:
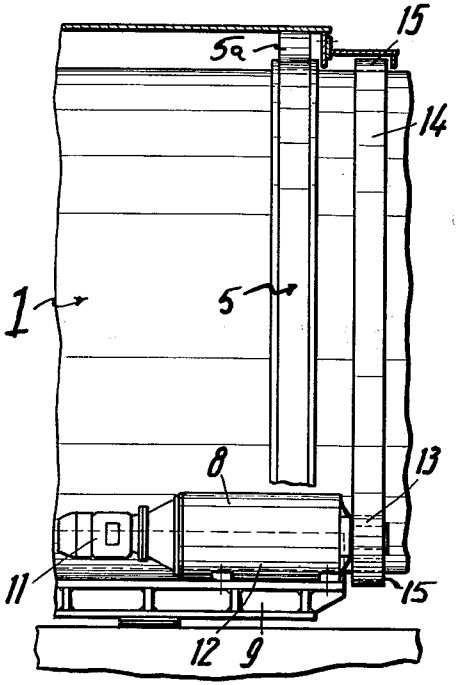
FIG. 5 is a fragmentary, side elevational view of the apparatus of FIG. 3 showing details of mounting of the self-contained driving unit for rotating the mixing vessel.

As shown in FIG. 5, the inner race 5 for the roller bearing 7 is affixed directly to the outer shell of the vessel 1. The reinforced saddle member 6, which bears most of the load of the vessel 1 as it is rotated about its longitudinal axis, has a socket formed at its centralmost lower surface, which socket engages the ball element of the ball joint 3, as will be understood and as is indicated in FIGS. 3 and 4.

The support structure for the vessel 1 includes laterally extending arms or struts 9 projecting outwardly, at the ends of the vessel, from the saddle member 6, as shown best in FIGS. 4 and 5. These struts 9 support drive units 8, 8*a*, as shown in FIG. 4, each of which is of sufficient horsepower to provide the necessary torque to drive an endless roller chain 14 which, in turn, rotates the vessel 1. The chain 14 engages a driving sprocket 13 mounted on the motor output shaft thereof and a vessel drive sprocket wheel 15 fastened directly to the vessel 1 (FIG. 3). More specifically, each drive unit 8, 8*a* includes a motor 11 (FIG. 5), a clutch with a brake (not shown) and a reduction gear 12 (indicated schematically in FIG. 5), which delivers the driving output to the aforementioned sprocket wheel 13, as indicated schematically in FIG. 5.

The sides of the vessel 1 are provided with lifting lugs 16, which may be engaged by a crane or other heavy lifting apparatus to elevate the vessel with respect to the underlying railway trucks and to separate the vessel therefrom. At the midpoint of the longitudinal vessel 1, a port structure 17, communicating with the interior of the vessel, is provided for filling and emptying the vessel in known manner.

The opposite ends of the vessel 1 are closed off by cover plates or heads 18 bolted thereto. As shown, the heads 18 include hook members 19 to facilitate their handling by mechanized auxiliary equipment. As is the case with all mixer-transports of this general type, the vessel 1 is completely lined with conventional refractory material 20.

As an important advantage of the present invention, the refractory lining of the mixer-transport may be replaced in the following manner without great difficulty: The head cover members 18 are removed, for example, by means of a crane engaging the hooks 19, and the refractory lining closing off the ends of the vessel is removed, making the vessel essentially into an open cylindrical tube. In this condition, access to the remainder of the refractory lining may be easily had, and the lining may be worked upon efficiently with mechanized equipment by rotating the vessel through the self-contained drive units 8, 8*a*, in the manner described hereinabove. Of course, the specific speeds chosen as well as the torques applied by the drive units may be adjusted to the particular equipment and methods being employed to fracture and to remove the refractory linings. Advantageously, the aforementioned process of removing the refractory, preparatory to replacing the same, is performed after the vessel has been removed from the underlying railway trucks 2. Typically, a crane or other heavy lifting equipment is used to engage the lugs 16 or the arms 9, to lift the vessel from the carriage and to place it on a shop stand or other suitable support, adjacent the railroad tracks, for engaging the undersides of the arms 9. As will be understood and in accordance with the principles of the invention, the vessel may be readily rotated while on the shop stand by the self-contained drive unit; moreover, the vessel and its self-contained drive unit may be supported, after its removal from the underlying railway truck, in any particular orientation ranging from the horizontal to the vertical. The particular position or positions in which the vessel is oriented on the shop stand will be or may be designed for the best results and most efficient performance of each of the particular steps in the lining process. As will be readily apparent, with the vessel tilted or otherwise supported in a steeply inclined position, the fractured refractory lining may be removed without the necessity of workers having to intervene. Thus, the vessel may be tipped on its end and rotated while a hammering mechanism breaks up the refractory, permitting the broken refractory to slide downwardly and outwardly of the rotating vessel by gravity.

It should be understood that the mixer-transport railway apparatus herein illustrated and described is intended to be representative only, as certain changes may be made therein without departing from the teachings of the disclosure. Accordingly, reference should be made to the following appended claims in determining the scope of the invention.

We claim:

1. A mixer-transport apparatus for molten metals or the like comprising a. a longitudinal, cylindrical vessel having a refractory lining and removable end covers;

b. bearing means journalling said vessel for rotation about the longitudinal axis thereof;

c. support structure means connected to said bearing means for supporting said bearing means and said vessel;

d. underlying wheeled truck means mounting said support structure means;

e. joint means disposed between said truck means and said support structure means accommodating the separation of said support structure means from said underlying truck means; and f. self-contained drive unit means for rotating said vessel mounted on said support structure means and forming with said vessel, said bearing means and said support structure means, a single structural entity for separation as a whole from said underlying truck means.

2. The apparatus of claim 1, further characterized in that a. said support structure means includes strut means projecting outwardly from said vessel;

b. said self-contained driving means are supported on said strut means.

3. The apparatus of claim 1, further characterized in that a. said self-contained driving unit means are disposed adjacent the ends of said vessel.

4. A mixer-transport apparatus for molten metals or the like, comprising a. a longitudinal, cylindrical vessel having a refractory lining and removable end covers;

b. bearing means journalling said vessel for rotation about the longitudinal axis thereof;

c. said bearing means including circular roller bearings with inner and outer races;

d. support structure means for said bearing means and said vessel;

e. said outer race affixed directly to said support structure means and said inner race affixed directly to said vessel;

f. underlying wheeled truck means mounting said support structure means;

g. joint means disposed intermediately of said truck means and said support structure means accommodating the selective separation of said support structure means from said underlying truck means; and h. self-contained drive unit means for rotating said vessel mounted on said support structure means, and forming with said vessel, said bearing means and said support structure means, a single structural entity which may be selectively separated as a whole from said underlying truck means.

5. The apparatus of claim 4, further characterized in that a. the central lower portions of said outer race are in the form of a reinforced saddle segment.

6. The apparatus of claim 5, further characterized in that a. the lower surfaces of said saddle segment include socket means for engaging a ball means;

b. said separable joint means is in the form of a ball joint, including said socket means and a ball means.

7. The apparatus of claim 5, further characterized in that a. said outer race includes upper plate-like elements which cooperate with said lower saddle segment to define a circular race;

b. said inner race and said outer race cooperate to define an annular retainer;

c. a plurality of roller elements disposed in said annular retainer end accommodate the smooth rotation of said vessel about its longitudinal axis.

8. The apparatus of claim 7, further characterized in that a. sprocket wheel means are affixed to the outer surface of said vessel;

b. said self-contained driving unit includes a sprocket drive wheel means;

c. an endless roller chain interconnects said sprocket wheel means for transmitting torque from said self-contained drive unit to said vessel to rotate the same.

* * * * *